United States Patent [19]

Saarinen

[11] 4,042,474

[45] Aug. 16, 1977

[54] SEPARATING NICKEL, COBALT AND CHROMIUM FROM IRON IN METALLURGICAL PRODUCTS

[75] Inventor: Heimo Unto August Saarinen, Huovintie, Finland

[73] Assignee: Pako Corporation, Minneapolis, Minn.

[21] Appl. No.: 590,478

[22] Filed: June 26, 1975

Related U.S. Application Data

[63] Continuation of Ser. No. 385,183, Aug. 2, 1973, abandoned, which is a continuation-in-part of Ser. No. 334,870, Feb. 22, 1973, abandoned.

[51] Int. Cl.[2] ..... C25C 1/06

[52] U.S. Cl. ..... 204/112; 423/53; 423/140; 423/146; 423/150

[58] Field of Search ..... 423/53, 55, 140, 141, 423/146, 150; 75/108, 119, 121, 101 R; 204/112

[56] References Cited

U.S. PATENT DOCUMENTS

| | | | |
|---|---|---|---|
| 1,503,229 | 7/1924 | Clark | 75/108 |
| 2,842,436 | 7/1958 | Dasher et al. | 75/101 R |
| 3,434,947 | 3/1969 | Steintveit | 75/121 |
| 3,493,365 | 2/1970 | Pickering et al. | 423/146 X |
| 3,682,592 | 8/1972 | Kovacs | 423/140 |
| 3,847,594 | 11/1974 | Van Der Menlen | 423/138 |

OTHER PUBLICATIONS

World Symposium on Mining and Metallurgy of Lead and Zinc AIME, New York, 1970, vol. 2, pp. 228–231, (Cotterill, Ed.).

*Primary Examiner*—O. R. Vertiz
*Assistant Examiner*—Brian E. Hearn
*Attorney, Agent, or Firm*—John W. Adams

[57] ABSTRACT

A finely divided product containing Ni and Fe is dissolved in a sulfate-containing solvent in at least two stages and in the presence of an alkali metal and an oxidant for preciptating the Fe as alkali jarosite while Ni remains in solution which is subjected to an after-treatment. Similar processes can be used to separate cobalt and/or chromium from products containing either or both of these metals as well as iron.

6 Claims, 3 Drawing Figures

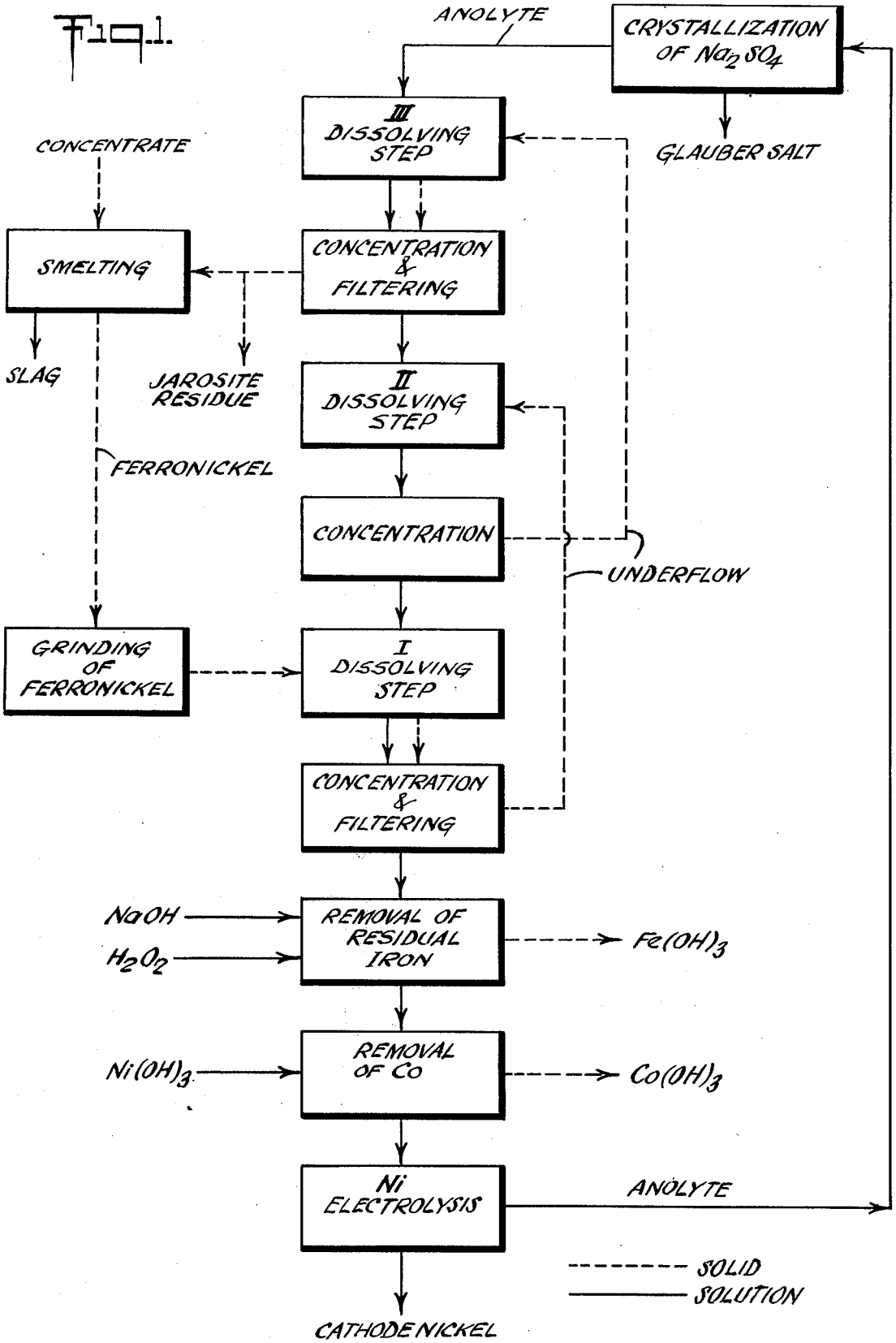
Fig. 1.
ANOLYTE
CRYSTALLIZATION OF $Na_2SO_4$
III DISSOLVING STEP
GLAUBER SALT
CONCENTRATE
SMELTING
CONCENTRATION & FILTERING
SLAG
JAROSITE RESIDUE
II DISSOLVING STEP
FERRONICKEL
CONCENTRATION
UNDERFLOW
GRINDING OF FERRONICKEL
I DISSOLVING STEP
CONCENTRATION & FILTERING
NaOH
$H_2O_2$
REMOVAL OF RESIDUAL IRON
$Fe(OH)_3$
$Ni(OH)_3$
REMOVAL OF Co
$Co(OH)_3$
Ni ELECTROLYSIS
ANOLYTE
SOLID
SOLUTION
CATHODE NICKEL

SEPARATING NICKEL, COBALT AND CHROMIUM FROM IRON IN METALLURGICAL PRODUCTS

CROSS-REFERENCE TO RELATED APPLICATIONS

This is a continuation of application Ser. No. 385,183, filed Aug. 2, 1973, which is a Continuation-in-Part of my prior copending application Ser. No. 334,870 filed Feb. 22, 1973 and entitled PROCESS FOR SEPARATING NICKEL AND IRON FROM METALLURGICAL PRODUCTS, both now abandoned.

BACKGROUND OF THE INVENTION

1. Field of the Invention

This invention relates to a process for separating nickel, cobalt and/or chromium from iron in metallurgical products, e.g. ferronickel, ferrocobalt and ferrochromium, containing these metals.

2. Description of the Prior Art

Several metals are refined electrolytically by using insoluble anodes; a raw material containing the metal, usually a roasted product, is dissolved in the acid produced in the electrolysis, and the solution obtained is purified chemically by a separate process before it is fed back into the electrolysis. It is known that zinc can be so refined.

Pure nickel is produced hydrometallurgically by the use of insoluble anodes; by using soluble, so-called sulfide matte anodes; or by dissolving this sulfide matte chemically and purifying it into an electrolyte.

The latter case must be considered the present state of the art to which production processes have been developed.

The process for dissolving sulfidic raw material which contains nickel is not applicable as such to the dissolution of ferronickel because of the great amount of iron dissolved from it in the solution, the difficult treatment of the precipitate so produced, and the slowness of its dissolution. A dissolution and purification process based on sulfates was desired for ferronickel, in particular, a process from which the above disadvantages had been eliminated.

There are difficulties which often occur in the hydrometallurgical treatment of products with high iron contents such as ferronickel, ferrocobalt and ferrochromium; precipitation of the iron, filtering the obtained ferrihydroxide precipitate, and above all washing the precipitate sufficiently clean of the mother liquor.

Too much of the valuable metal content of the mother liquor is removed with the precipitate. Furthermore, it is very difficult to remove from the electrolytic cell the anode sludge produced in the electrolytic dissolution of ferronickel and other iron-containing materials. Attempts have been made to develop processes for the treatment of ferronickel, and one such process is introduced in Finnish Pat. No. 44,300, in which ferronickel is dissolved electrolytically as an anode, and the impure nickel solution thereby produced is purified chemically by a separate process and the obtained pure nickel-containing solution is pumped into the cathode chamber of the electrolysis, where the nickel is precipitated onto the cathode with the help of electricity.

The solution used is a chloride-based electrolyte which is said to have a good anodic corrosive effect but which is even otherwise highly corrosive (muriatic acid + chloride) to the entire apparatus and the rest of the surroundings. Poisonous chlorine gas easily develops during the electrolysis which must be used for the chemical purification of the anolyte and for the removal of both iron and cobalt.

SUMMARY OF THE INVENTION

The process of the present invention separates nickel, cobalt and/or chromium from iron in metallurgical products containing iron and one or more of the other metals mentioned. The term product is used to include not only roasted products typically treated but other raw materials containing the aforementioned metals. In this summary the process is discussed primarily as it applies to ferronickel, but it should be understood that similar steps and results are employed and obtained in treating other iron-containing materials also containing nickel, cobalt, chromium or combinations thereof.

In the process according to the present invention, ferronickel is dissolved in a sulfate-based electrolyte which does not possess the disadvantages of a chloride-based electrolyte. Preferably, ferronickel is dissolved in sulfuric acid (produced by electrolysis) and the solution obtained from a second step is simultaneously purified so that the great amount of dissolved iron can be precipitated and removed, and at the same time essentially all the nickel contained in the ferronickel can be dissolved in spite of the disadvantageous effect of the presence of iron.

In the process according to the invention, the additional expenses due to chemicals used in the prior art have also been eliminated; such chemicals would be necessary if a conventional process for purifying a solution obtained by dissolving sulfide-based finely-ground nickel matte were used for the treatment of ferronickel.

With the help of the present invention a sufficiently pure electrolyte solution is thus obtained rather simply for a nickel electrolysis to be carried out with insoluble anodes using for raw material ferronickel mixtures with different iron contents. According to the invention, ferronickel is dissolved in the return acid (anolyte) of the nickel electrolysis carried out with insoluble anodes, and the impure nickel sulfate solution obtained by the dissolution is purified by the process described below, so that the solution is sufficiently pure and has a suitable nickel content for the electrolysis.

According to the invention, the dissolution in an acid takes place in a multistage dissolution system under such conditions that the iron contained in the ferronickel dissolves during these stages and then precipitates from the solution without preventing thorough dissolution, and in addition the dissolution is suitably catalyzed.

Ferronickel may contain varying amounts of iron depending on the raw materials and the pyrometallurgical treatment. The process according to the invention is also suitable for ferronickel mixtures with high iron contents. The iron content accepted in the ferronickel meant for raw material of electrolytic nickel is an economical and technical question, in other words, proportionately how much iron can be removed economically—there are no technical hindrances.

The objects and advantages of the process of the invention will be more fully understood from the following detailed description of preferred embodiments, taken in conjunction with the accompanying drawing.

BRIEF DESCRIPTION OF THE DRAWING:

FIG. 1 is a simplified diagram of the process of separating nickel from ferronickel according to the invention.

DESCRIPTION OF THE PREFERRED EMBODIMENTS

Figure 2:
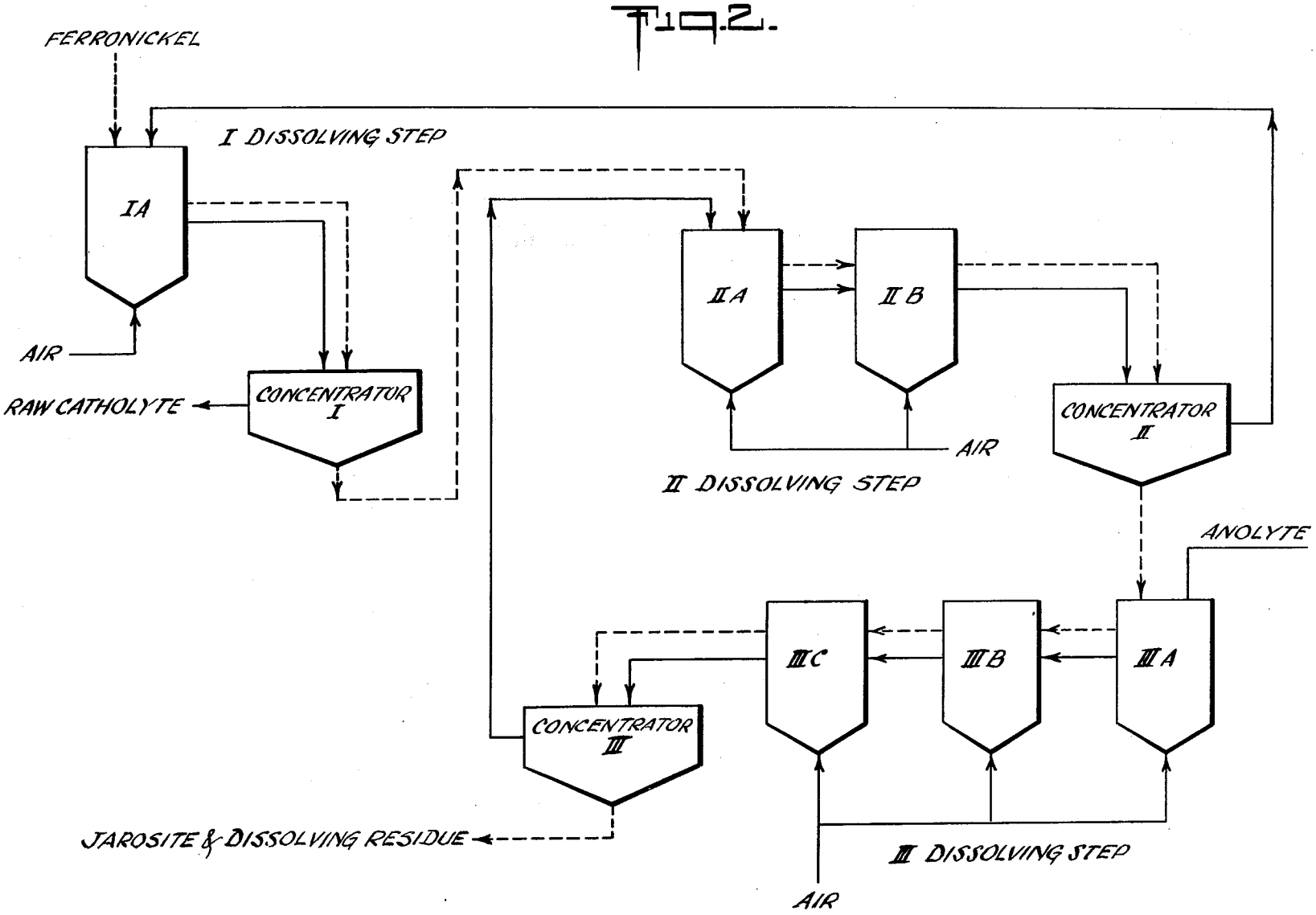
FIG. 2 is a schematic illustration of an installation for performing the process of the invention.

The process of the invention will first be described as applied to ferronickel, but it should be understood that ferrochromium and ferrocobalt or other combinations of iron with one or more of the metals nickel, cobalt and chromium can also be separated to produce pure metals according to the invention. The starting material, i.e. some combination of iron with one or more of the other metals must be grindable. Typically the material to be treated according to the invention can be the product of a metallurgical process such as roasting.

Thus, a prerequisite for the success of ferronickel dissolution is that the ferronickel must be brought to such a form during metallurgical processing that it can be ground. Ferronickel can suitably be brought to a form suitable for grinding by adding some sulfur to it during a smelting phase. A prerequisite for grinding ferronickel is also that the ferronickel has been granulated in water. The step of adding sulfur can perhaps be replaced by adding carbon in connection with smelting, in which case the carbon must remain in the ferronickel in a graphitic form, or possibly by adding silicon. The smallest sulfur content required for making ferronickel more suitable for grinding is 0.8%. Unless otherwise specifically indicated, percentages given throughout this specification are percentages by weight.

Ferronickel prepared in the manner described above is ground by the wet grinding process in a grinding drum using steel balls. 85% – 200 mesh is a sufficiently small granule size. The dissolution of ferronickel takes place in three stages according to the outline shown in FIG. 1.

In the first dissolution stage the ferronickel meets the solution emerging from the second phase, which solution contains some tens of milligrams of copper and about one gram of iron per liter. Ferronickel cements the copper from the solution.

The main reaction in the first phase is the oxidation of the iron contained in the ferronickel into ferrihydroxide under the influence of air blown through the reactors $$2\,Fe + 1\tfrac{1}{2}\,O_2 + 3\,H_2O = 2\,Fe(OH)_3\downarrow.$$

Part of the iron in the solution also oxidizes into trivalent iron and is precipitated; the pH of the solution rises to 5.5 – 6.2. After this oxidation stage the solid material is separated from the solution in a thickener. The solution is conducted out of the leach circuit and the underflow of the thickener is pumped into the second leaching stage where it meets the solution emerging from the third leaching stage. The solution fed into the second stage contains as active components about 2–4 g/l iron and 2–5 g/l copper, and its pH is about 2–3. The nickel contained in the ferronickel cements the copper from the solution and simultaneously dissolves according to reaction equation.

$$Ni + Cu^{++} = Ni^{++} + Cu\downarrow.$$

The iron in the ferronickel also participates in this cementation reaction $$Fe + Cu^{++} = Fe^{++} + Cu\downarrow.$$

The cemented copper is oxidized by air into copper oxide according to reaction equation $$Cu + \tfrac{1}{2}\,O_2 = CuO.$$

Under the influence of the acid in the solution the copper oxide dissolves into copper sulfate according the reaction equation $$CuO + 2\,H^+ = Cu^{++} + H_2O.$$

Thus the reactions continue until all sulfuric acid has been neutralized and the pH has risen to 4.0–4.5. The ferrihydroxide which has entered together with the ferronickel neutralizes the acid, and thus dissolving ferric iron dissolves nickel and iron according to reaction equations $$2\,Fe^{3+} + Ni = 2\,Fe^{++} + Ni^{++}$$

and $$2\,Fe^{3+} + Fe = 3\,Fe^{++}.$$

After the acid has neutralized to the said pH range, most of the ferrous iron reoxidizes into ferrihydroxide according to reaction equation $$2\,Fe^{++} + 5\,H_2O + \tfrac{1}{2}\,O_2 = Fe(OH)_3\downarrow + 4H^+.$$

The hydrogen ion (sulfuric acid) released in this reaction dissolves iron according to reaction equation $$Fe + \tfrac{1}{2}\,O_2 + 2\,H^+ = Fe^{++} + H_2O,$$

and the ferrous iron formed oxidizes according to reaction equation $$2\,Fe^{++} + 2\,H^+ + \tfrac{1}{2}\,O_2 = 2\,Fe^{3+} + H_2O.$$

When there is no more sulfuric acid (pH = 3.5), the ferric iron precipitates into ferrihydroxide in the manner indicated by equation $$2\,Fe^{3+} + 6\,H_2O = 2\,Fe(OH)_3\downarrow + 6\,H^+.$$

By adding together the two above reactions, reaction equation $$2\,Fe^{++} + 5\,H_2O + \tfrac{1}{2}\,O_2 = 2\,Fe(OH)_3\downarrow + 4\,H^+$$

mentioned above is obtained. When further reaction equations $$Fe + \tfrac{1}{2}\,O_2 + 2\,H^+ = Fe^{++} + H_2O,$$

$$2\,Fe^{++} + 2\,H^+ + \tfrac{1}{2}\,O_2 = 2\,Fe^{3+} + H_2O,$$

ps when there is no more sulfuric acid (pH = 3.5), and $$2\,Fe^{3+} + 6\,H_2O = 2\,Fe(OH)_3\downarrow + 6\,H^+$$

are added together, reaction equation $$2\,Fe + 1\tfrac{1}{2}\,O_2 + 3\,H_2O = 2\,Fe(CH)_3\downarrow$$

is obtained. From this it can be noted that the total reaction in the second dissolution stage is exactly the same as in the first stage, that is, the oxidation of metallic iron into ferrihydroxide.

After the second dissolution stage, the solid material is separated from the solution in a thickener, the overflow of which is fed into the first leaching stage and the underflow into the third leaching stage. In this third leaching stage the partly reacted and unreacted ferronickel meets the overflow (anolyte) emerging from the nickel electrolysis and which contains as an active component about 45–50 g/l sulfuric acid. The following reactions occur in this third dissolution stage—the most important one considering nickel. The bulk of the sulfuric acid in the solution is immediately neutralized by the ferrihydroxide entering along with the solid material so that the sulfuric acid content in the first reactor of the third phase settles at the level of a few grams.

$$Fe(OH)_3 + 3\,H^+ = Fe^{3+} + 3\,H_2O.$$

According to reaction equation $$2\,Fe^{3+} + Ni = 2\,Fe^{++} + Ni^{++}$$

the dissolved ferric iron dissolves nickel in the solution, thereby reducing itself into bivalent iron, and according to reaction equation $$2\,Fe^{3+} + Fe = 3\,Fe^{++}$$

it dissolves the iron of the ferronickel if there is any present in a metallic form. The actual cementation reactions in which copper is involved also take place in this dissolution stage, above all in its first reactor $$Ni + Cu^{++} = Ni^{++} + Cu\downarrow,$$

$$Fe + Cu^{++} = Fe^{++} + Cu\downarrow,$$

$$Cu + \tfrac{1}{2}\,O_2 = CuO,$$

and $$CuO + 2\,H^+ = Cu^{++} + H_2O.$$

The dissolution of ferronickel is very rapidly completed and thus a solution is obtained which contains, besides nickel, ferrous iron and copper. At this stage the pH of the solution has risen to about 2 (1.5–3). Because the solution circulating in the process contains about 30–50 g/l sodium and because the third dissolution stage is carried out at a temperature of over 90° C and under highly oxidizing circumstances (air blowing), all the prerequisites for the precipitation of sodium jarosite exist. thus, iron precipitates into crystalline sodium jarosite which is easy to filter, and the iron content of the solution decreases considerably. Depending on the nickel/iron ratio in the ferronickel the iron content may increase to 20 g/l or more. After the precipitation of jarosite, the iron content of the solution is about 2–4 g/l depending on the reaction period and the temperature of the solution. Jarosite is precipitated according to reaction equation $$3\,Fe_2(SO_4)_3 + Na_2SO_4 + 12\,H_2O = 2\,NaFe_3(SO_4)_2.(OH)_6\downarrow + 6\,H_2SO_4.$$

As can be seen from this reaction equation, sulfuric acid is released in connection with the precipitation of jarosite. The sulfuric acid so released reacts with copper oxide, thereby forming copper sulfate. If any ferronickel capable of reacting is still present, it becomes completely dissolved. Thus, in the third phase it can be clearly observed how the copper content of the solution increases while its iron content decreases. After the dissolution, the undissolved residue is separated from the solution in a thickener and then filtered. The overflow from the thickener is pumped into the second leaching stage.

In addition to the reactions described above, certain secondary reactions occur during the dissolution; the iron of the ferronickel reacts and releases hydrogen according to reaction equation $$Fe + 2\,H^+ = Fe^{++} + H_2\downarrow.$$

Because the ferronickel also contained some sulfur to make it easier to grind as mentioned above, this sulfur is now bound to either nickel or iron, bo both. This sulfide is released according to reaction equation $$Me_xS_y + 2\,yH^+ = yH_2S + xMe^{++}$$

(Me = Ni or Fe) as hydrogen sulfide which precipitates nickel according to reaction equation $$H_2S + Ni^{++} = NiS\downarrow + 2H^+$$

and copper according to reaction equation $$H_2S + Cu^{++} = CuS + H^+.$$

Consequently, the undissolved residue (jarosite) contains small quantities of nickel sulfide and copper sulfide. The copper which acts as a catalyst in the oxidation of nickel in the dissolution process also acts as a catalyst in the oxidation of ferrous iron into ferric iron. As can be seen from the reaction equations, copper is precipitated in the first and second dissolution stages and dissolves in the third dissolution stage, from which it returns in the solution into the first dissolution stage. Thus, in principle, copper is in an internal circulation and only the small losses occurring in connection with the removal of undissolved residue and jarosite have to be compensated for with a small addition of copper. If copper is present in the ferronickel, it reduces this need of adding copper or eliminates it completely. If more copper is present in the ferronickel than it removed from the system together with the undissolved residue, a separate removal of copper must be provided for in the dissolution circuit. This can be arranged either by attaching a electrolytic copper removal system to the circuit or be feeding a small part of the solution of the third dissolution phase into a side circuit where the necessary removal of copper is performed with a small amount of ferronickel.

Because some iron is still present in the solution obtained from the first dissolution phase, it is practical to remove this iron by oxidizing it with hydrogen peroxide or to remove it as ferrihydroxide in a separate aeration reactor before the electrolysis. If cobalt must be removed from the solution by using nickel (III) hydroxide, then the removal of iron before the removal of cobalt considerably reduces the need of nickel (III) hydroxide when the said removal of iron takes place separately. If desired, the removal of iron can easily be carried out in connection with the removal of cobalt. If lead is present in the ferronickel, the lead must be removed in connection with the dissolution process, for example, by using barium carbonate, in which case the lead is removed together with the jarosite precipitate. If manganese is present in the ferronickel, the manganese must be removed in connection with the removal of cobalt. The same applies to arsenic; the arsenic remains partly undissolved in the jarosite precipitate, but if it dissolves, it is removed in connection with the removal of cobalt. If zinc is present in the ferronickel in such large quantities that it is necessary to remove it before the nickel electrolysis, the removal must be carried out before or after the removal of iron, for example, with hydrogen sulfide or by solvent extraction. Silicon and carbon present in the ferronickel are removed together with the combined undissolved residue and jarosite.

After the nickel electrolysis, the overflow — anolyte — from the electrolytic tanks is fed into the third dissolution stage. In order to maintain the sodium sulfate balance, the part of sodium sulfate which is not removed together with the jarosite precipitate must be crystallized from the dissolution circuit. Sodium is fed into the process in connection with the removal of iron (sodium hydroxide) and the removal of cobalt together with nickel (III) hydroxide (sodium hydroxide and sulfate). If the total amount of sodium is greater than the amount of sodium removed along with jarosite, sodium sulfate must be crystallized as mentioned above. If the said hydroxide quantities are smaller than the amount of sodium removed along with jarosite, sodium sulfate must be fed into the process. The consumption of sodium sulfate is naturally greater when the amount of jarosite produced is greater, in other words, when the nickel/iron ratio in the ferronickel is smaller.

This invention thus relates to a dissolution process described above in which ferronickel or some other metallurgical product (matte) containing nickel and a great quantity of iron is dissolved in the solution — anolyte — returned from the nickel electrolysis and which solution contains among other things sulfuric acid, nickel sulfate, and sodium sulfate. The dissolution takes place in one or more phases.

FIG. 2 shown an operational scheme of a three-stage dissolution installation for ferronickel. The first dissolving stage consists of one, the second of two, and the third one of three reactors.

Three examples of the dissolution of ferronickel with different compositions are given below. The reactors are identified in accordance with FIG. 2, and the raw material analyses are in percentages by weight. Solution analyses are expressed in grams per liter, except for the pH.

EXAMPLE 1

Analysis of ferronickel:

| | | |
|---|---|---|
| Ni | = | 80 % |
| Fe | = | 13 % |
| Cu | = | 2 % |
| S | = | 1 % |
| Other | = | 4 % |

Analyses of solution at different stages of the dissolution process:

| | $H_2SO_4$ g/l | pH | Cu g/l | Fe g/l | Ni g/l |
|---|---|---|---|---|---|
| Anolyte | 50 | | 0 | 0 | 60 |
| Reactor III A | 5 | | 2.0 | 6.0 | 79 |
| Reactor III B | — | 2.0 | 2.5 | 5.0 | 81 |
| Reactor III C | — | 1.8 | 3.0 | 4.0 | 82 |
| Reactor II A | — | 4.0 | 0.05 | 2.0 | 87 |
| Reactor II B | — | 4.5 | 0.05 | 1.0 | 89 |
| Reactor I A | — | 6.0 | 0.002 | 0.9 | 89 |

Over 99% of the nickel in the ferronickel is dissolved. 80% of the iron fed into the system is precipitated as jarosite and removed along with residue.

EXAMPLE 2

Analysis of ferronickel:

| | | |
|---|---|---|
| Ni | = | 54 % |
| Fe | = | 40 % |
| S | = | 1 % |
| Other | = | 5 % |

Analyses of solution at different stages of dissolution:

| | $H_2SO_4$ g/l | pH | Cu g/l | Fe g/l | Ni g/l |
|---|---|---|---|---|---|
| Anolyte | 50 | | 0 | 0 | 60 |
| Reactor III A | — | 1.0 | 2.0 | 14 | 74 |
| Reactor III B | — | 2.0 | 2.5 | 7 | 80 |
| Reactor III C | — | 1.8 | 3.0 | 5 | 82 |
| Reactor II A | — | 4.0 | 0.05 | 3 | 86 |
| Reactor II B | — | 4.5 | 0.05 | 1 | 89 |
| Reactor I A | — | 6.0 | 0.002 | 1 | 89 |

99.5% of the nickel in the ferronickel is dissolved. Over 90% of the iron fed into the system is precipitated and removed as jarosite.

EXAMPLE 3

Analysis of ferronickel:

| | | |
|---|---|---|
| Ni | = | 40 % |
| Fe | = | 54 % |
| S | = | 1 % |
| Other | = | 5 % |

Analyses of solution at different stages of dissolution:

| | $H_2SO_4$ g/l | pH | Cu g/l | Fe g/l | Ni g/l |
|---|---|---|---|---|---|
| Anolyte | 50 | | 0 | 0 | 60 |
| Reactor III A | — | 1.0 | 2.0 | 16 | 71 |
| Reactor III B | — | 2.0 | 2.5 | 10 | 77 |
| Reactor III C | — | 1.8 | 3.0 | 7 | 80 |
| Reactor II A | — | 3.5 | 0.05 | 4 | 86 |
| Reactor II B | — | 4.0 | 0.05 | 1 | 89 |
| Reactor I A | — | 5.5 | 0.002 | 1 | 89 |

Over 99% of the nickel in the ferronickel is dissolved. Over 95% of the iron fed into the system is precipitated as jarosite.

EXAMPLE 4

Analysis of ferronickel:

| | | |
|---|---|---|
| Ni | = | 30 % |
| Fe | = | 64 % |
| S | = | 1 % |

-continued

| | | |
|---|---|---|
| Other | = | 5 % |

Analyses of solution at different stages of dissolution:

| | $H_2SO_4$ g/l | pH | Cu g/l | Fe g/l | Ni g/l |
|---|---|---|---|---|---|
| Anolyte | 50 | | 0 | 0 | 60 |
| Reactor III A | — | 1.0 | 2.0 | 20 | 67 |
| Reactor III B | — | 2.0 | 2.5 | 12 | 75 |
| Reactor III C | — | 1.8 | 3.0 | 8 | 78 |
| Reactor II A | — | 4.0 | 0.05 | 5 | 85 |
| Reactor II B | — | 4.5 | 0.05 | 2 | 88 |
| Reactor I A | — | 5.5 | 0.002 | 1 | 89 |

Over 98% of the nickel in the ferronickel is dissolved. Over 97% of the iron fed into the system is precipitated.

Analyses of undissolved residue in the foregoing Examples:

| Example | 1 | 2 | 3 | 4 |
|---|---|---|---|---|
| Ni-% | 1.4 | 0.6 | 0.5 | 0.3 |
| Fe-% | 33.0 | 33.0 | 33.0 | 33.0 |
| S-% | 10.0 | 10.0 | 10.0 | 10.0 |
| Na-% | 4.0 | 4.0 | 4.0 | 4.0 |

Ferrocobalt and ferrochromium can also be treated to separate metallic cobalt and chromium in a manner similar to that described above with respect to ferronickel. A prerequisite is that the raw material to be processed must be grindable. To effect this, some sulfur is added to the ferrocobalt or ferrochromium usually in a metallurgical treatment process prior to the separation process of the invention, as in the case of ferronickel already described. The product obtained is granulated into water.

Figure 3:
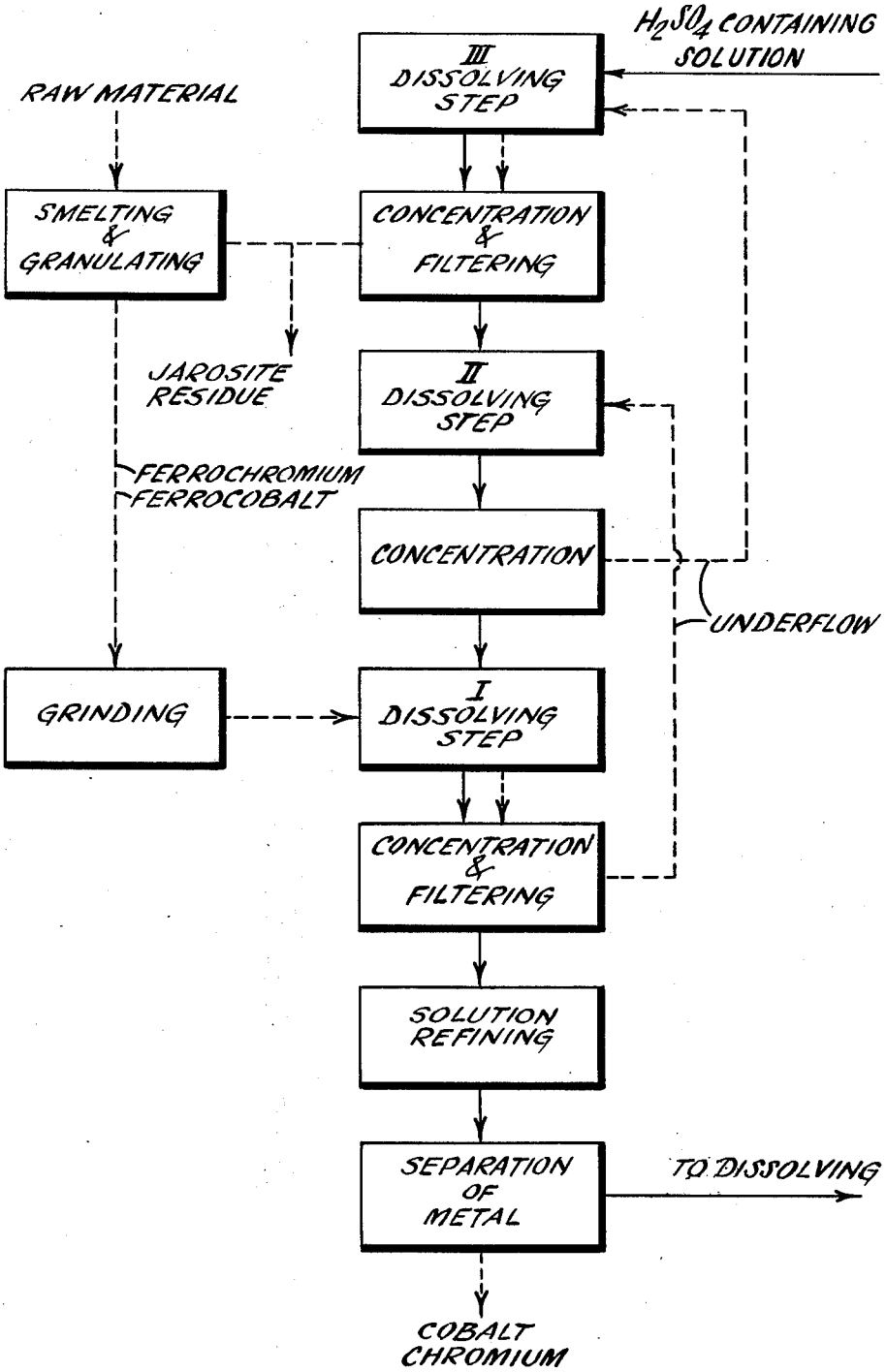
FIG. 3 is a simplified diagram of the process according to the invention as applied to ferrocobalt and/or ferrochromium.

The process is substantially identical to that of dissolving ferronickel and is illustrated in FIG. 3.

The following examples of analyses similar to those of Examples 1 – 4 show the efficiency of the process of the invention for separating cobalt and chromium from iron. Again, percentages are by weight and solutions are measured in grams per liter. The reactors are those of FIG. 2, with only the starting material changed.

EXAMPLE 5

Analysis of ferrocobalt:

| | | |
|---|---|---|
| Co | = | 80 % |
| Fe | = | 15 % |
| S | = | 1 % |
| Other | = | 4 % |

Analyses of solution at different stages of dissolution:

| | $H_2SO_4$ g/l | pH | Cu g/l | Fe g/l | Co g/l |
|---|---|---|---|---|---|
| $H_2SO_4$ containing solution | 50 | — | 0 | 0 | 60 |
| Reactor III A | 5 | — | 2.0 | 7 | 78 |
| Reactor III B | — | 2.0 | 2.5 | 5 | 81 |
| Reactor III C | — | 1.8 | 3.0 | 4 | 82 |
| Reactor II A | — | 4.0 | 0.05 | 2 | 87 |
| Reactor II B | — | 4.5 | 0.05 | 1 | 89 |
| Reactor I A | — | 6.0 | 0.002 | 1 | 89 |

EXAMPLE 6

Analysis of ferrochromium:

| | | |
|---|---|---|
| Cr | = | 80 % |
| Fe | = | 15 % |
| S | = | 1 % |
| Other | = | 4 % |

Analyses of solution at different stages of dissolution:

| | $H_2SO_4$ g/l | pH | Cu g/l | Fe g/l | Cr g/l |
|---|---|---|---|---|---|
| $H_2SO_4$ containing solution | 50 | — | 0 | 0 | 60 |
| Reactor III A | 5 | — | 2.0 | 5 | 71 |
| Reactor III B | — | 2.0 | 2.5 | 4 | 72 |
| Reactor III C | — | 1.8 | 3.0 | 3 | 73 |
| Reactor II A | — | 4.0 | 0.05 | 2 | 76 |
| Reactor II B | — | 4.5 | 0.05 | 1 | 77 |
| Reactor I A | — | 6.0 | 0.002 | 1 | 77 |

Over 99% of the cobalt and chromium of the ferrocobalt and ferrochromium of Examples 5 and 6 is dissolved. Over 80% of the iron fed into the ferrocobalt system is precipitated as jarosite and removed along with residue and over 70% in the dissolving of ferrochromium.

EXAMPLE 7

Analysis of ferrocobalt:

| | | |
|---|---|---|
| Co | = | 40 % |
| Fe | = | 55 % |
| S | = | 1 % |
| Other | = | 4 % |

Analyses of solution of different stages of dissolution:

| | $H_2SO_4$ g/l | pH | Cu g/l | Fe g/l | Co g/l |
|---|---|---|---|---|---|
| $H_2SO_4$ containing solution | 50 | — | 0 | 0 | 60 |
| Reactor III A | 5 | — | 2.0 | 20 | 65 |
| Reactor III B | — | 2.0 | 2.5 | 13 | 73 |
| Reactor III C | — | 1.8 | 3.0 | 7 | 79 |
| Reactor II A | — | 3.5 | 0.05 | 4 | 86 |
| Reactor II B | — | 4.0 | 0.05 | 2 | 88 |
| Reactor I A | — | 5.5 | 0.002 | 1 | 89 |

EXAMPLE 8

Analysis of ferrochromium:

| | | |
|---|---|---|
| Cr | = | 40 % |
| Fe | = | 55 % |
| S | = | 1 % |
| Other | = | 4 % |

Analyses of solution at different stages of dissolution:

| | $H_2SO_4$ g/l | pH | Cu g/l | Fe g/l | Cr g/l |
|---|---|---|---|---|---|
| $H_2SO_4$ containing solution | 50 | — | 0 | 0 | 60 |
| Reactor III A | 5 | — | 2.0 | 20 | 63 |
| Reactor III B | — | 2.0 | 2.5 | 13 | 67 |
| Reactor III C | — | 1.8 | 3.0 | 7 | 71 |

-continued

| | $H_2SO_4$ g/l | pH | Cu g/l | Fe g/l | Cr g/l |
|---|---|---|---|---|---|
| Reactor II A | — | 3.5 | 0.05 | 4 | 75 |
| Reactor II B | — | 4.0 | 0.05 | 2 | 76 |
| Reactor I A | — | 5.5 | 0.002 | 1 | 77 |

Over 99% of the cobalt and chromium of the ferrocobalt and ferrochromium of Examples 7 and 8 is dissolved. Over 95% of the iron of the ferrocobalt and ferrochromium fed into the system is precipitated as jarosite.

Analyses of undissolved residues from dissolving ferrocobalt and ferrochromium:

| Example | 5 | 6 | 7 | 8 |
|---|---|---|---|---|
| Co-% | 1.4 | — | 0.5 | — |
| Cr-% | — | 1.6 | — | 0.6 |
| Fe-% | 33.0 | 33.0 | 33.0 | 33.0 |
| S-% | 10.0 | 10.0 | 10.0 | 10.0 |
| Na-% | 4.0 | 4.0 | 4.0 | 4.0 |

When iron is precipitated as jarosite within the dissolution circuit, as in the process according to the present invention, a considerable advantage is gained in that half of the acid used for the dissolution of the iron in the ferronickel, ferrocobalt or ferrochromium is released inside the dissolution circuit and can be used for the dissolution o the nickel, cobalt or chromium of the material treated. If iron is not precipitated as jarosite in the manner described above, it must be precipitated outside the dissolution circuit in connection with the purification of the solution, which is the usual procedure. In this case the acid used in the dissolution circuit is not released until outside the circuit (in connection with the ferrihydroxide precipitation). Then it can no longer be used for the dissolution of nickel, cobalt or chromium, but must be neutralized with some base, usually sodium hydroxide. Considerable savings in chemical expenses are thus achieved by using jarosite precipitation: 50% of the sulfuric acid needed for the dissolution of the iron in the ferronickel, ferrocobalt or ferrochromium, and almost 100% of the sodium hydroxide required for its precipitation.

It will be understood by those acquainted with the art that the process of the invention is applicable to raw materials or metallurgical products containing some combination of two or more of the metals cobalt, chromium and nickel with iron, as well as to ferronickel, ferrocobalt and ferrochromium.

What is claimed is:

1. A process for separating one or more non-ferrous metals selected from the group consisting essentially of nickel, cobalt and chromium from iron by treatment of a metallurgical product consisting essentially of at least one of ferronickel, ferrocobalt and ferrochromium in addition to sulfur, carbon or silicon, comprising in combination:

leaching the metallurgical product counter-currently in at least two steps with dilute sulfuric acid to a final pH in a last one of said leaching steps of 5.5 to 6.2 in admixture with oxygen for oxidizing iron to form ferric hydroxide and dissolve the non-ferrous metals to form a pregnant leach solution in the first of said leaching steps and separating solid material containing undissolved non-ferrous metal or metals and said ferric hydroxide from said last leaching step;

b. then adding to the solid material from said last leaching step of (a) sulfuric acid solution to dissolve the non-ferrous metal or metals and the ferric hydroxide and precipitating iron as alkali jarosite in the presence of alkali metal ions at elevated temperature under oxidizing conditions, using copper as an oxidation catalyst;

c. maintaining the temperature of the acid solution formed in step (b) above about 90° C and the pH for step (b) between 1 and 3.5; and d. finally separating the alkali jarosite precipitate from the solution containing the non-ferrous metal or metals and feeding said solution to the last leaching step of (a).

2. A process according to claim 1, wherein said metallurgical product is introduced to step (a) in finely-divided form having a particle size of less than 85%–200 mesh.

3. A process according to claim 1, wherein about 30–50 g sodium per liter of solution is used as the alkali metal.

4. A process according to claim 1, wherein the metallurgical product is a finely-divided ferronickel containing 30–80% Ni, 13–64% Fe, 0–2% Cu and about 1% S.

5. The process of claim 1 wherein the non-ferrous metal is nickel and including purification of the solution from step (d), treating the purified solution by nickel electrolysis and recirculating acid electrolyte from said electrolysis to step (a).

6. The process of claim 1, wherein the acid solution used contains 45–50 g/l $H_2SO_4$ as its active component.

* * * * *

UNITED STATES PATENT AND TRADEMARK OFFICE

CERTIFICATE OF CORRECTION

PATENT NO. : 4,042,474

DATED : August 16, 1977

INVENTOR(S) : Heimo Unto August Saarinen

It is certified that error appears in the above-identified patent and that said Letters Patent are hereby corrected as shown below:

Title Page: Assignee is misdesignated.

"[73] Assignee: Pako Corporation, Minneapolis, Minn." should read --[73] Assignee: Outukumpu Oy, Helsinki, Finland--

Attorney, Agent or Firm misdesignated.

"Attorney, Agent, or Firm, - John W. Adams" should read --Attorney, Agent, or Firm - Brooks Haidt Haffner & Delahunty--

Col. 4, Line 63 - omit "ps"

Line 67 - "2 $Fe(CH)_3\downarrow$" should read --2 $Fe(OH)_3\downarrow$--

Col. 6, Line 16 - end of equation "$H_2\downarrow$" should read --$H_2\uparrow$--

Line 20 - "bo" should read --or--

Line 49 - "it" should read --is--

Line 54 - "be" should read --by--

Col. 11, Line 29 - "o" should read --of--

Signed and Sealed this

Third Day of January 1978

[SEAL]

Attest:

RUTH C. MASON
Attesting Officer

LUTRELLE F. PARKER
Acting Commissioner of Patents and Trademarks